US009136582B2

(12) United States Patent
Lewry et al.

(10) Patent No.: US 9,136,582 B2
(45) Date of Patent: Sep. 15, 2015

(54) COMPACT ANTENNA MOUNT

(71) Applicant: Andrew LLC, Hickory, NC (US)

(72) Inventors: Matthew R Lewry, Limekilns (GB); Alastair Douglas Wright, Edinburgh (GB)

(73) Assignee: CommScope Technologies LLC, Hickory, NC (US)

( * ) Notice: Subject to any disclaimer, the term of this patent is extended or adjusted under 35 U.S.C. 154(b) by 154 days.

(21) Appl. No.: 13/900,769

(22) Filed: May 23, 2013

(65) Prior Publication Data

US 2014/0346294 A1 Nov. 27, 2014

(51) Int. Cl.

| | |
|---|---|
| ***H01Q 1/12*** | (2006.01) |
| ***H01Q 3/08*** | (2006.01) |
| ***H01Q 3/04*** | (2006.01) |

(52) U.S. Cl.

CPC ..... *H01Q 1/125* (2013.01); *H01Q 3/04* (2013.01); *H01Q 3/08* (2013.01)

(58) Field of Classification Search

CPC ..... H01Q 1/1207; H01Q 1/125; H01Q 3/04; H01Q 3/06; H01Q 3/08

USPC ..... 343/878, 880, 882, 890, 891, 892, 757, 343/763, 765, 766; 248/218.4, 219.3, 248/219.4, 227.3, 227.4, 288.11, 291.1; 74/89.32; 269/43, 45, 271

See application file for complete search history.

(56) References Cited

U.S. PATENT DOCUMENTS

| | | | | |
|---|---|---|---|---|
| 4,800,394 | A | 1/1989 | Homann et al. | |
| 4,819,007 | A | 4/1989 | Tezcan | |
| 5,453,753 | A | 9/1995 | Cosenza et al. | |
| 5,508,712 | A | 4/1996 | Tom et al. | |
| 5,735,174 | A * | 4/1998 | Enomoto | 74/89.32 |
| 5,835,068 | A | 11/1998 | Paul et al. | |
| 5,867,132 | A | 2/1999 | Blasing et al. | |
| 6,031,508 | A | 2/2000 | Ishizuka et al. | |
| 6,211,845 | B1 | 4/2001 | Cook et al. | |
| 6,262,691 | B1 | 7/2001 | Austin et al. | |
| 6,264,152 | B1 | 7/2001 | Bloch et al. | |
| 6,342,870 | B1 * | 1/2002 | Mehrkens et al. | 343/891 |
| 6,404,400 | B1 | 6/2002 | Tulloch | |
| 6,407,713 | B1 | 6/2002 | Mallenius | |

(Continued)

OTHER PUBLICATIONS

Ericsson AB, Installing a 0.3 m HP Antenna Mini-Link, Sep. 28, 2011, Sweden.

(Continued)

*Primary Examiner* — Jonathan Liu
*Assistant Examiner* — Guang H Guan
(74) *Attorney, Agent, or Firm* — Babcock IP, PLLC

(57) ABSTRACT

An antenna mount is provided with a bracket with an azimuth slot, an azimuth pivot hole and a boss hole. An azimuth adjuster with an extension portion passes through a boss seated in the boss hole. An offset portion of the azimuth adjuster has an azimuth fastener aperture spaced apart from a longitudinal axis of the extension portion. An azimuth fastener passes through the base, the azimuth slot and the azimuth fastener aperture. An azimuth pivot fastener passes through the base and the azimuth pivot hole. The azimuth slot is provided as an arc segment with a center point at the azimuth pivot hole. Adjustment of a longitudinal position along the extension portion of an interconnection between the boss and the extension portion drives the azimuth fastener within the azimuth slot to pivot the base about the azimuth pivot hole with respect to the bracket.

8 Claims, 12 Drawing Sheets

(56) References Cited

U.S. PATENT DOCUMENTS

| | | | | |
|---|---|---|---|---|
| 6,445,361 | B2 | 9/2002 | Liu et al. | |
| 6,480,161 | B2 | 11/2002 | Watson | |
| 6,512,492 | B2 * | 1/2003 | Overton | 343/891 |
| 6,657,598 | B2 | 12/2003 | Tulloch | |
| 6,709,184 | B1 * | 3/2004 | McDonald | 403/98 |
| 6,963,316 | B1 * | 11/2005 | Lin | 343/882 |
| 7,046,210 | B1 * | 5/2006 | Brooker et al. | 343/880 |
| 7,050,012 | B2 * | 5/2006 | Chen | 343/757 |
| 7,113,144 | B2 | 9/2006 | Lin et al. | |
| 7,150,541 | B2 * | 12/2006 | Burton | 362/273 |
| 7,164,391 | B2 | 1/2007 | Lin et al. | |
| 7,265,732 | B2 * | 9/2007 | Lin | 343/882 |
| 7,268,743 | B2 * | 9/2007 | Lin | 343/880 |
| 7,408,526 | B2 * | 8/2008 | Pan | 343/880 |
| 7,466,285 | B2 * | 12/2008 | Lin et al. | 343/882 |
| 8,020,824 | B2 * | 9/2011 | Pan | 248/299.1 |
| 8,052,107 | B2 * | 11/2011 | Yang et al. | 248/201 |
| 8,339,329 | B2 * | 12/2012 | Shen | 343/882 |
| 8,378,919 | B2 | 2/2013 | Yeh | |
| 8,451,187 | B2 * | 5/2013 | Zihlman | 343/882 |
| 8,698,694 | B2 * | 4/2014 | Lee et al. | 343/880 |
| 8,794,578 | B2 * | 8/2014 | Lin et al. | 248/218.4 |
| 8,797,228 | B2 * | 8/2014 | Yang et al. | 343/882 |
| 2005/0264467 | A1 | 12/2005 | Lin et al. | |
| 2008/0150831 | A1 | 6/2008 | Tulloch | |
| 2008/0165076 | A1 * | 7/2008 | Pan | 343/882 |
| 2010/0127946 | A1 | 5/2010 | Tung | |
| 2011/0074652 | A1 | 3/2011 | Lewry et al. | |
| 2011/0193764 | A1 | 8/2011 | Shen | |
| 2011/0304518 | A1 | 12/2011 | Fruh | |
| 2012/0211624 | A1 * | 8/2012 | Lin et al. | 248/292.14 |
| 2013/0134271 | A1 * | 5/2013 | Lee et al. | 248/219.2 |
| 2014/0346294 | A1 * | 11/2014 | Lewry et al. | 248/201 |

OTHER PUBLICATIONS

Sung Chul Kang, International Search Report for PCT application PCT/US2014/020475, Jun. 13, 2014, Daejeon Metropolitan City, Republic of Korea.

* cited by examiner

COMPACT ANTENNA MOUNT

BACKGROUND

1. Field of the Invention

This invention relates to antennas. More particularly, the invention relates to a compact adjustable antenna mount.

2. Description of Related Art

Antennas, such as reflector antennas for terrestrial microwave communication systems, may be highly directional. To maximize electrical performance, the antenna mount of an antenna may be finely adjustable for ease of obtaining a boresight alignment between antenna pairs forming an RF communications link. The antenna mount should maintain the selected alignment despite exposure over time to wind and/or ice loads acting upon the antenna that, depending upon the installation location, may rise to extreme levels during short periods such as storms. As a distance to the target antenna increases, even very small alignment shifts become significant. Should the antenna mount lose the desired boresight alignment, for example due to transient wind and/or ice loads, a significant expense may be incurred to return to a remote location such as atop a radio tower and repeat the alignment procedure.

Antenna mount ease of alignment adjustment and alignment stability characteristics may be improved in a trade-off with manufacturing cost and dimensional characteristics of the resulting antenna mount.

Competition in the antenna mount market has focused attention on improving alignment stability and ease of alignment adjustment while also minimizing overall manufacturing, inventory, distribution, installation and maintenance costs. Therefore, it is an object of the invention to provide a reflector antenna mount that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that the dimensions and therefore the wind load characteristics and/or material costs of an antenna mount may be reduced by limiting the size of structural elements to an extent of the desired mounting surfaces without sacrificing ease of adjustment by configuring the fine adjustment elements for access at a periphery of the antenna mount, positioned for easy tool access without interference with the mount structure.

Figure 1:
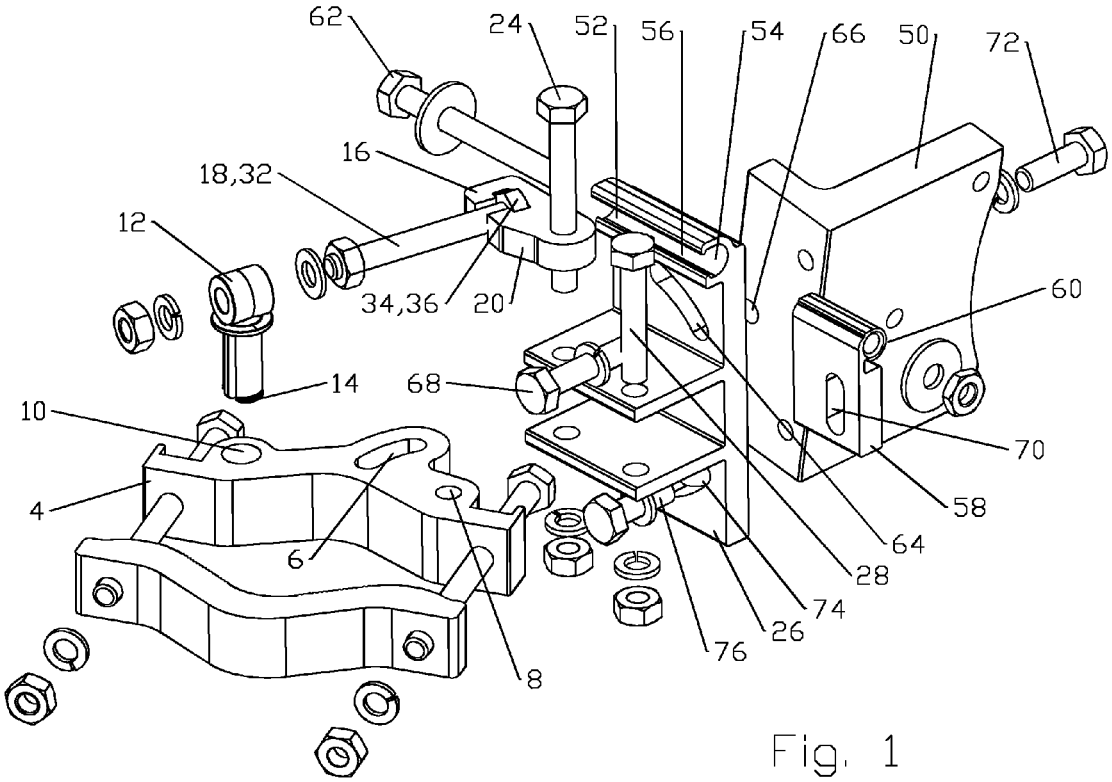
FIG. 1 is a schematic exploded isometric view of an exemplary antenna mount.
Figure 2:
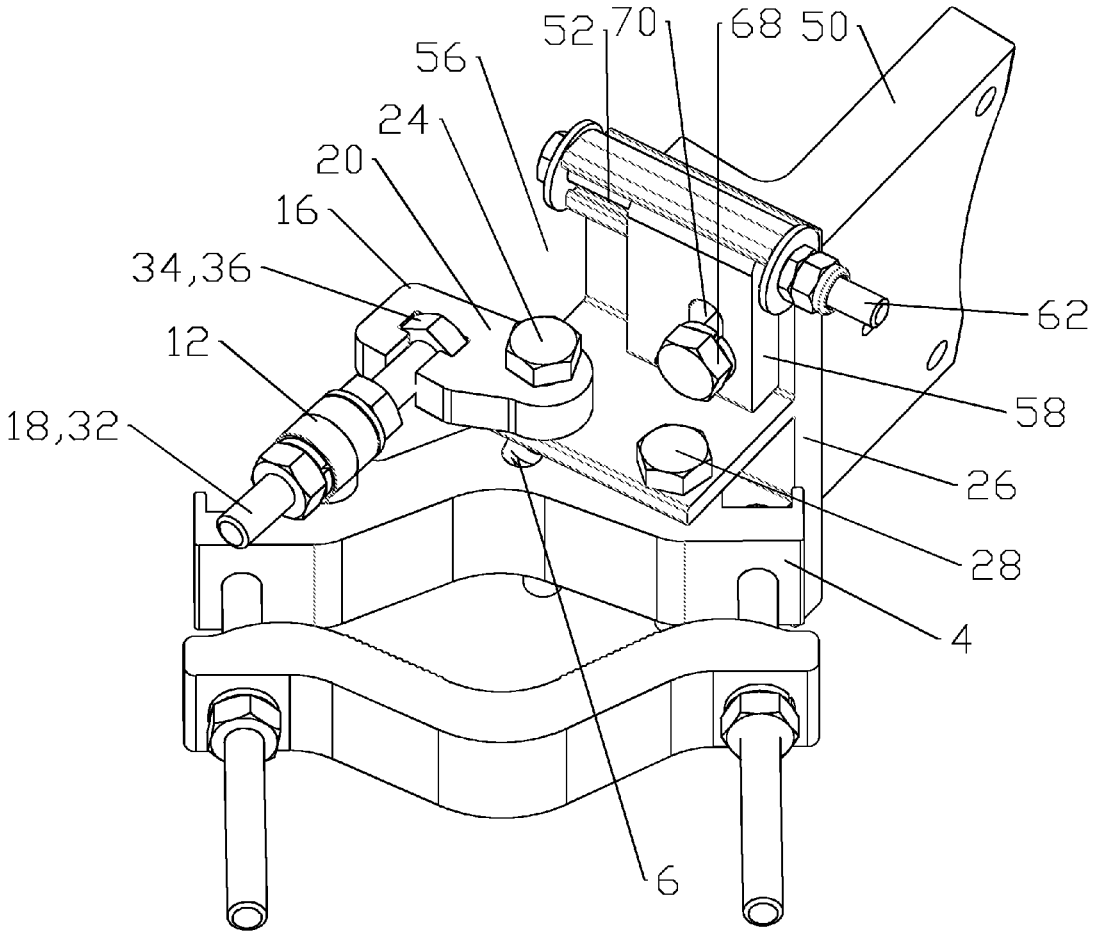
FIG. 2 is a schematic isometric view of the antenna mount of FIG. 1.
Figure 3:
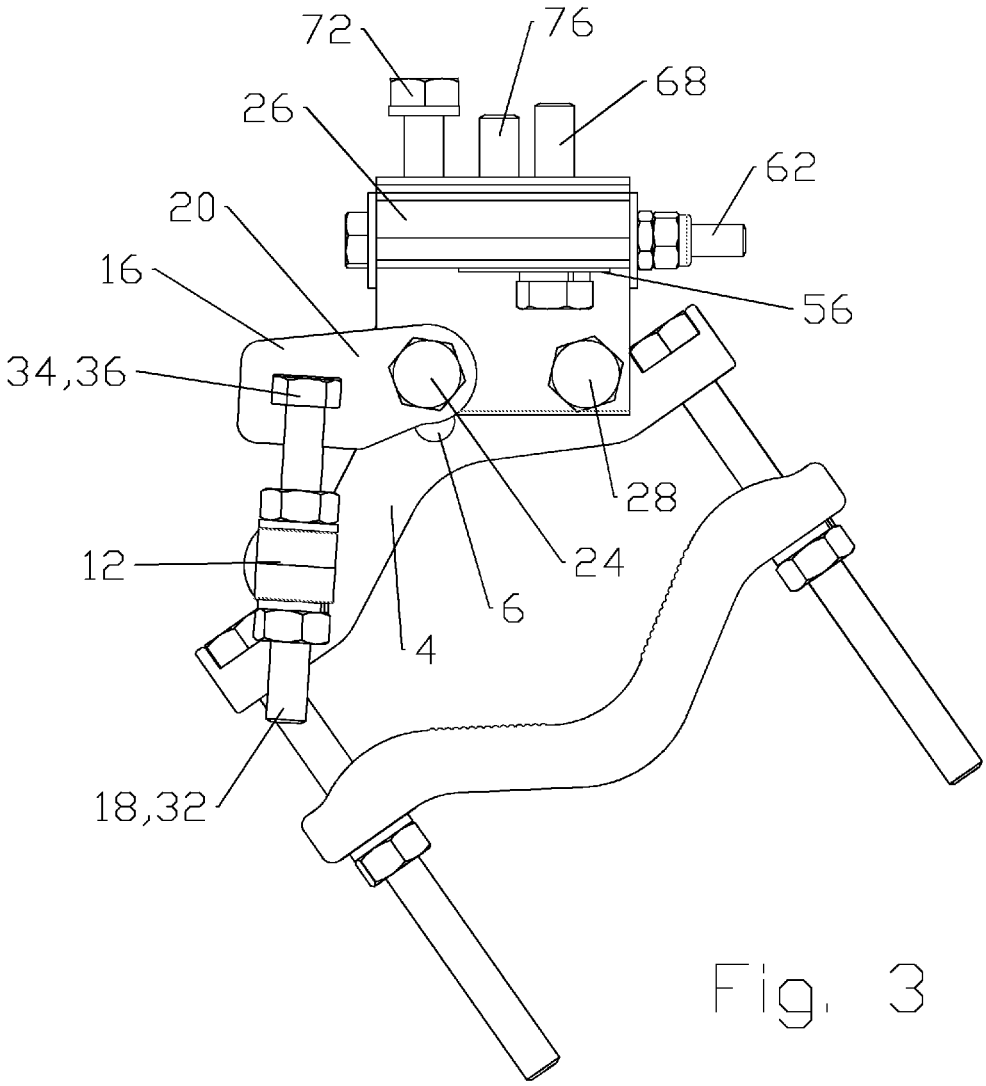
FIG. 3 is a schematic top view of the antenna mount of FIG. 1, mount removed.

As shown for example in FIGS. 1-3, an exemplary embodiment of an antenna mount has a bracket 4 with an azimuth slot 6, an azimuth pivot hole 8 and a boss hole 10. The boss hole 10 is dimensioned to receive a boss 12 that may be snap-fit inserted and retained in the boss hole 10, for example, by depressable retention tabs 14 of the boss 12. An azimuth adjuster 16 has an extension portion 18 dimensioned to pass through the boss 10 and an offset portion 20, the offset portion 20 provided with an azimuth fastener aperture 22 spaced apart from a longitudinal axis of the extension portion 18. An azimuth fastener 24 passes through the base 26, the azimuth slot 6 and the azimuth fastener aperture 22. An azimuth pivot fastener 28 passes through the base 26 and the azimuth pivot hole 8. The azimuth slot 6 is provided as an arc segment with a center point at the azimuth pivot hole 8 so that adjustment of a longitudinal position along the extension portion 18 of an interconnection between the boss 12 and the extension portion 18 drives the azimuth fastener 24 within the azimuth slot 6 to pivot the base 26 with respect to the bracket 4.

Figure 4:
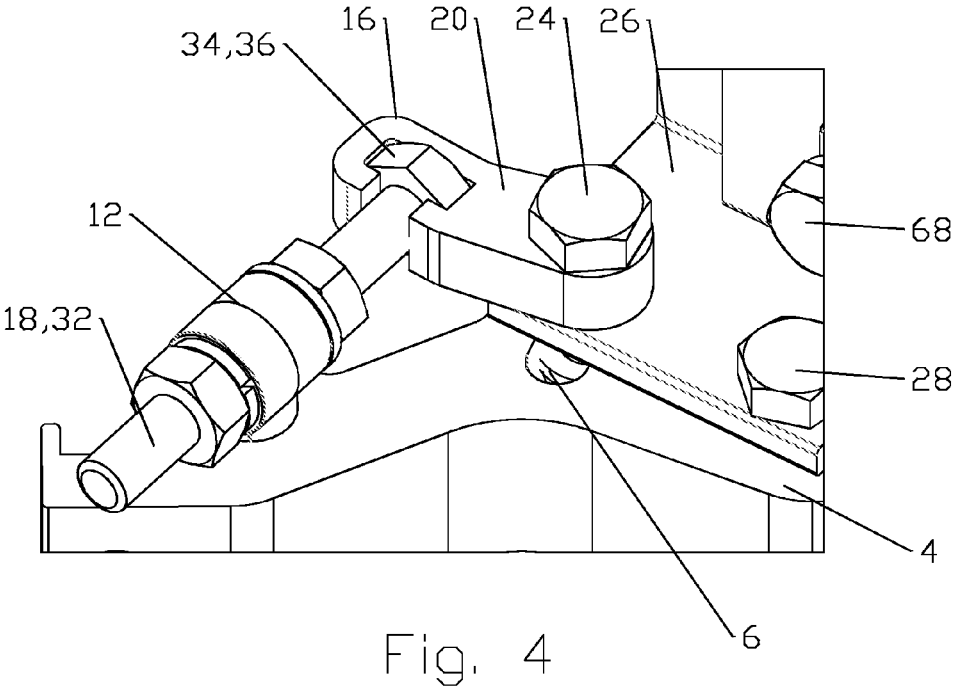
FIG. 4 is a schematic isometric view of the azimuth adjuster area of the antenna mount of FIG. 1.
Figure 5:
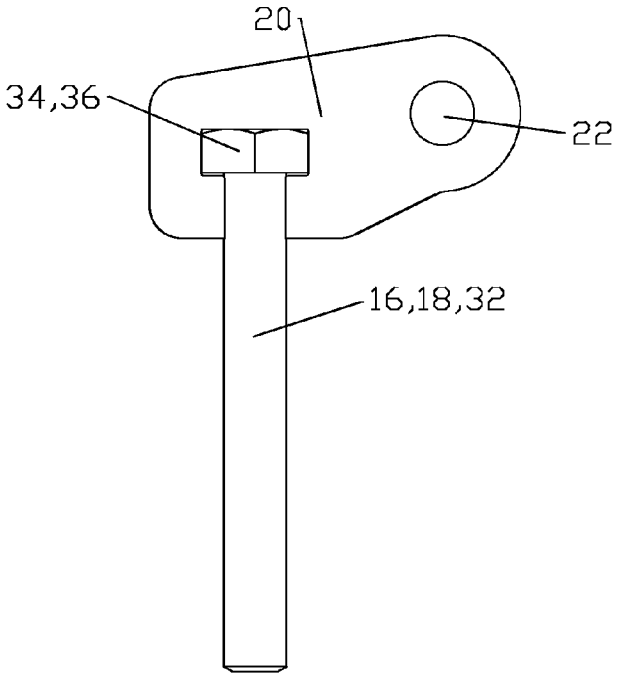
FIG. 5 is a schematic top view of the azimuth adjuster of FIG. 4.
Figure 6:
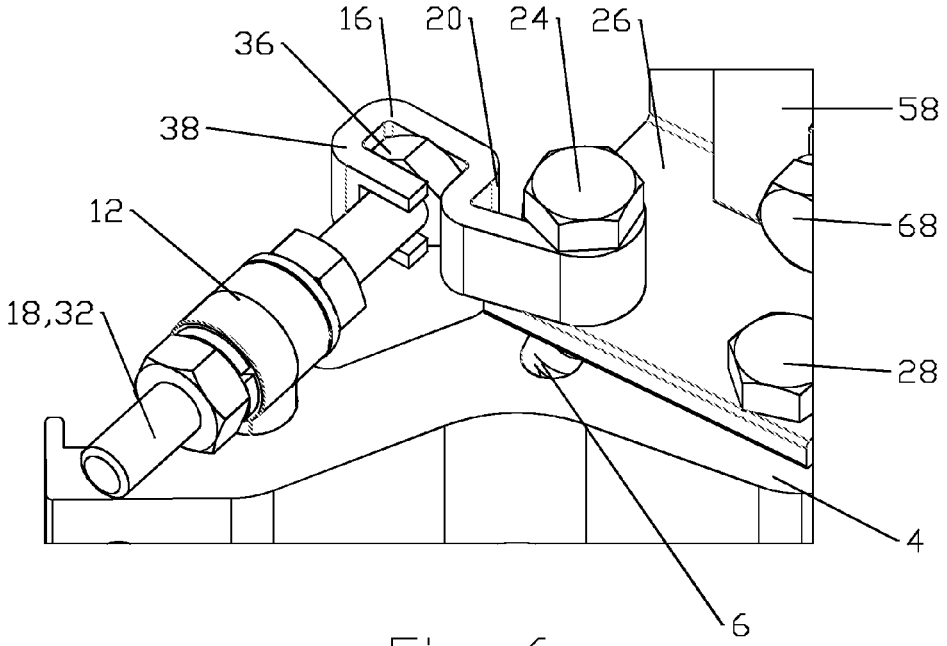
FIG. 6 is a schematic isometric view of an azimuth adjuster area of the antenna mount of FIG. 1, demonstrating an alternative azimuth adjuster embodiment.
Figure 7:
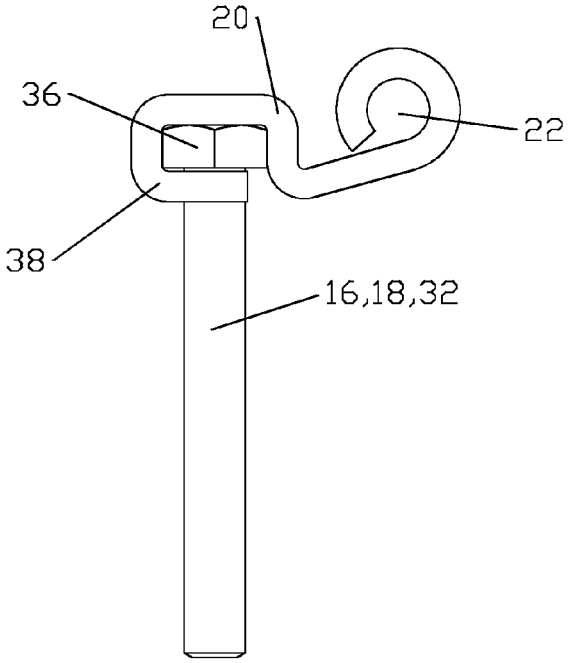
FIG. 7 is a schematic top view of the azimuth adjuster of FIG. 6.

The azimuth adjuster 16 may be applied in any embodiment where the azimuth fastener aperture 24 is spaced apart from the longitudinal axis of the extension portion 18. For example, as shown in FIGS. 4 and 5, the extension portion 18 may be a threaded fastener 32 coupled to the offset portion 20 via a bolt head slot 34 of the offset portion 20 dimensioned for an interference fit with a bolt head 36 of the threaded fastener 32. The extension portion 18 may be a machined, cast and/or molded portion of material or provided as a metal clip 38 coupled to the bolt head 36 of the threaded fastener 32 by bending of the metal clip 38 around the bolt head 36, for example as shown in FIGS. 6 and 7.

Figure 8:
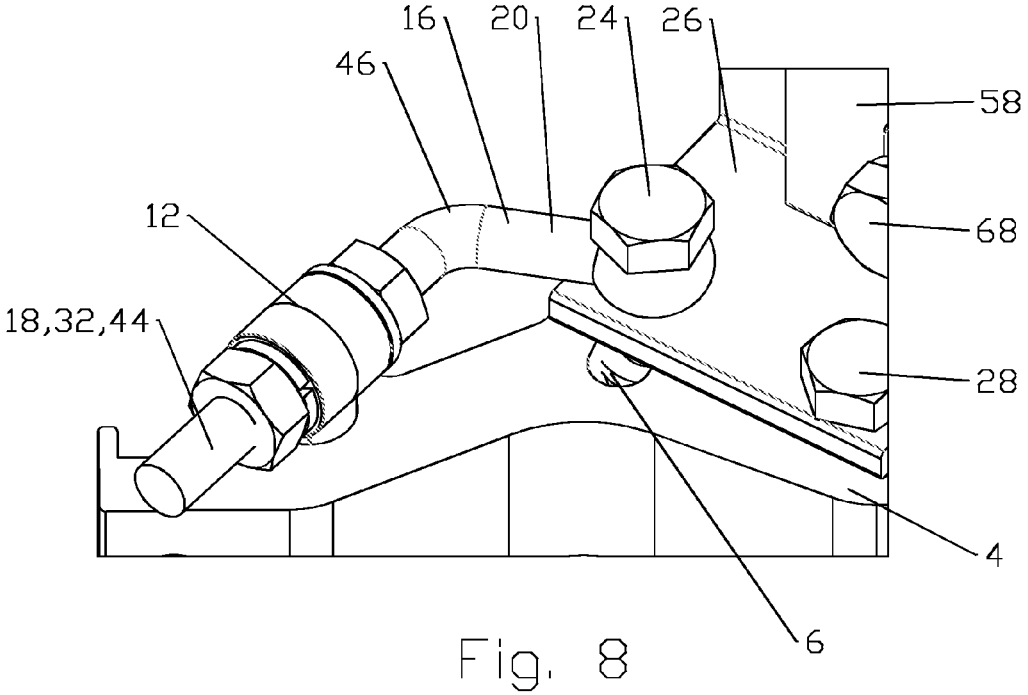
FIG. 8 is a schematic isometric view of an azimuth adjuster area of the antenna mount of FIG. 1, demonstrating an alternative azimuth adjuster embodiment.
Figure 9:
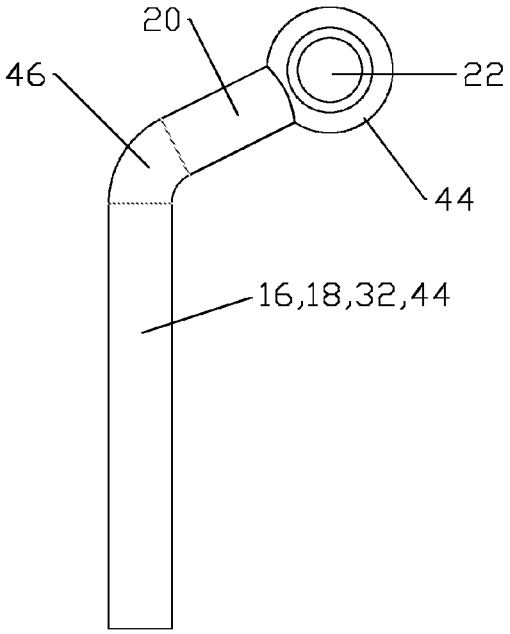
FIG. 9 is a schematic top view of the azimuth adjuster of FIG. 8.

The azimuth adjuster 16 may also be provided as an eye bolt 40 with an eye portion 42 and a threaded portion 44, the threaded portion 44 of the eye bolt 40 provided with a bend 46 dividing the threaded portion 44 into the extension portion 18 and the offset portion 20, for example as shown in FIGS. 8 and 9.

Figure 10:
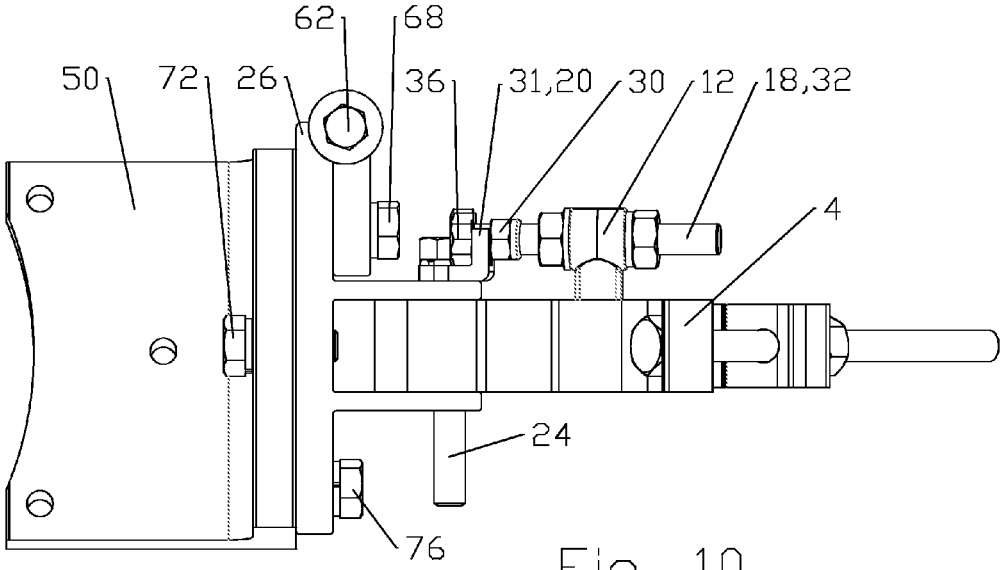
FIG. 10 is a schematic side view of the antenna mount of FIG. 1, demonstrating another azimuth adjuster embodiment.
Figure 11:
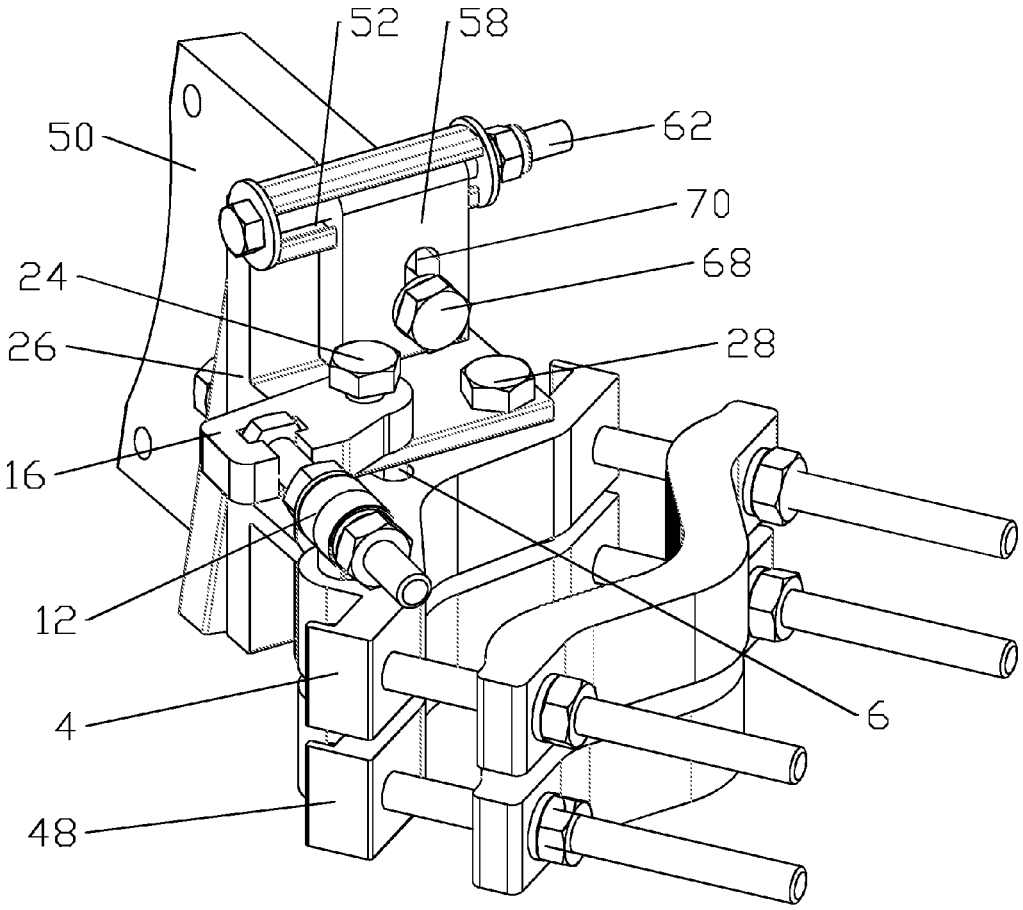
FIG. 11 is a schematic isometric view of the antenna mount of FIG. 1, further including a reinforcement bracket.

Alternatively, the azimuth adjuster 16 may utilize a portion of angled rail 31 or the like as the offset portion 20, wherein a threaded fastener 32 is coupled to the angled rail 31 via spot weld or threaded nut 30, for example as shown in FIG. 10.

One skilled in the art will appreciate that the extension portion 18 and offset portion 20 of the azimuth adjuster 16 combine to provide a lever arm which positions the interconnection between the boss 12 and the extension portion 18 spaced apart from the structure of the antenna mount for ease of tool access during adjustment. Also, the geometry of aligning the extension portion generally parallel with a line between the extents of the azimuth slot 6 can increase precision of adjustment, without resorting to non-standard fine threading of the extension portion 18 or the like. Further, the lever arm action of the azimuth adjuster 16 can enable the dimensions of the base 26 to be narrowed, reducing overall material requirements.

The narrowed base 26 resulting from the application of the azimuth adjuster 16 enables, for example, location of the azimuth slot 6 on the bracket 4 proximate a mid-point of the bracket 4 (see FIG. 1).

Where additional antenna mount strength is desired with respect to a coupling of the bracket 4 with a desired mounting point, such as a pole or the like, a reinforcing bracket 48 may be applied, the reinforcing bracket 48 provided adjacent the bracket 4, coupled to the bracket 4 by the azimuth fastener 24 and the azimuth pivot fastener 28. The reinforcing bracket 48 may also be provided after initial installation feedback indicates further interconnection reinforcement is needed, by providing the reinforcing bracket 48 in a kit form, comprising the reinforcement bracket 48 and extended length azimuth and azimuth pivot fasteners 24, 28.

Figure 12:
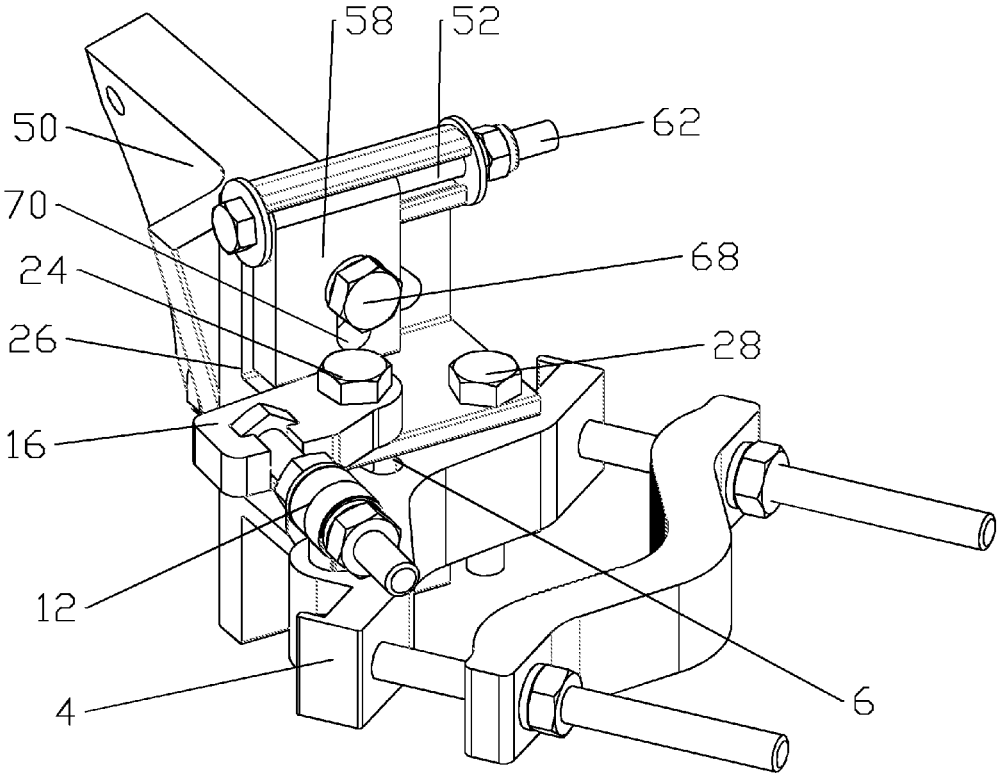
FIG. 12 is a schematic isometric view of the antenna mount of FIG. 1, at a minimum elevation pivot position.
Figure 13:
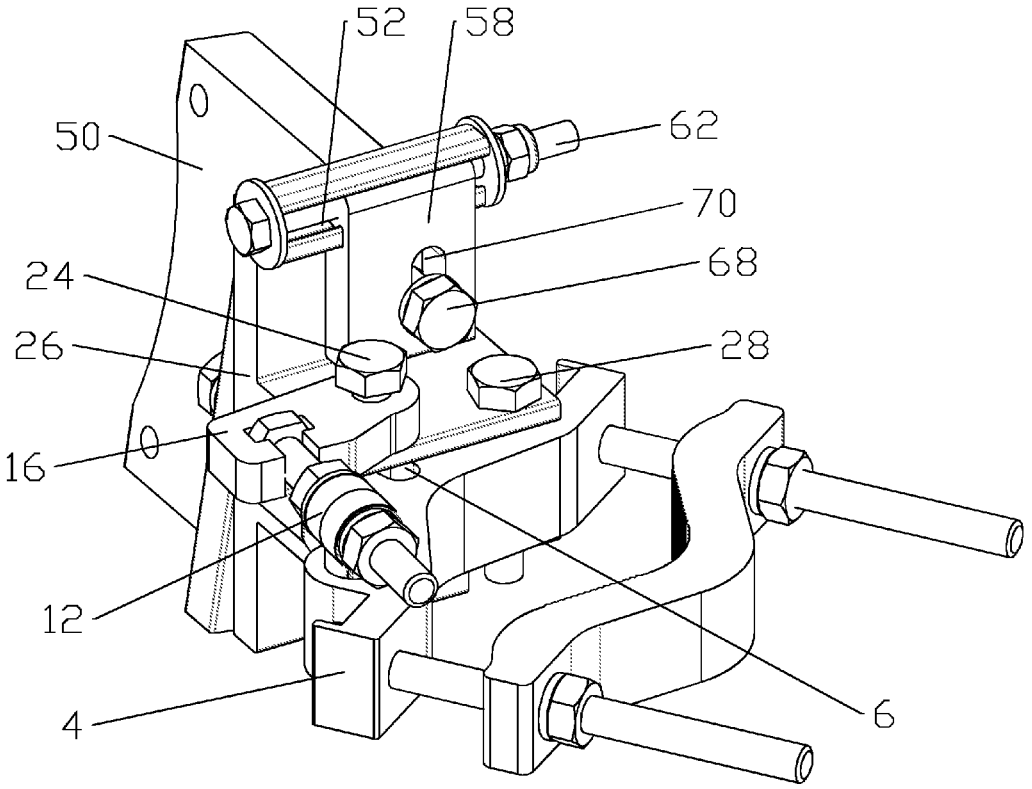
FIG. 13 is a schematic isometric view of the antenna mount of FIG. 1, at a maximum elevation pivot position.

As best shown in FIGS. 1, 12 and 13, the antenna mount may also include an additional range of adjustment capability by applying an additional adjustable pivot between the base 26 and, for example, a mount 50 or hub of an antenna.

The base 26 may be provided with an elevation groove 52, the elevation groove 52 provided with a groove bottom 54 open to a bracket side 56 of the base 26. An adjuster 58 has a groove face 60 dimensioned to seat within the elevation groove 52, slidable along a longitudinal axis of the elevation groove 52. An extension fastener 62 co-axial with the elevation groove 52 is threadably coupled with the adjuster 58 such that rotation of the extension fastener 62 drives the adjuster 58 longitudinally along the elevation groove 52. The base 26 is provided with a first elevation slot 64 and an elevation pivot hole 66, the first elevation slot provided as an arc segment with a center point at the elevation pivot hole 66. A first elevation alignment fastener 68 coupled to the mount 50 passes through an adjuster slot 70 of the adjuster 58 and the first elevation slot 64 and couples with the mount 50, for example by threading. An elevation pivot fastener 72 coupled to the mount 50 passes through the elevation pivot hole 66. Thereby, longitudinal displacement of the adjuster 58 along the elevation groove 52 moves the first elevation alignment fastener 68 along the first elevation slot, rotating the mount 50 with respect to the elevation pivot fastener 72.

One skilled in the art will appreciate that the elevation groove 52 with groove bottom 54 open to a bracket side 56 of the base 26 inhibits movement of the groove face 60 seated therein normal to the longitudinal axis of the elevation groove 52, preventing the adjuster 58 from racking vertically as the first elevation alignment fastener 68 moves up and down within the adjuster slot 70 during pivoting of the mount 50. Thereby, the adjuster 58 may be dimensioned with respect to the extent of the adjuster slot 70, rather than being supported at each end by features of the base 26, reducing material requirements of both the base 26 and the adjuster 58.

Figure 14:
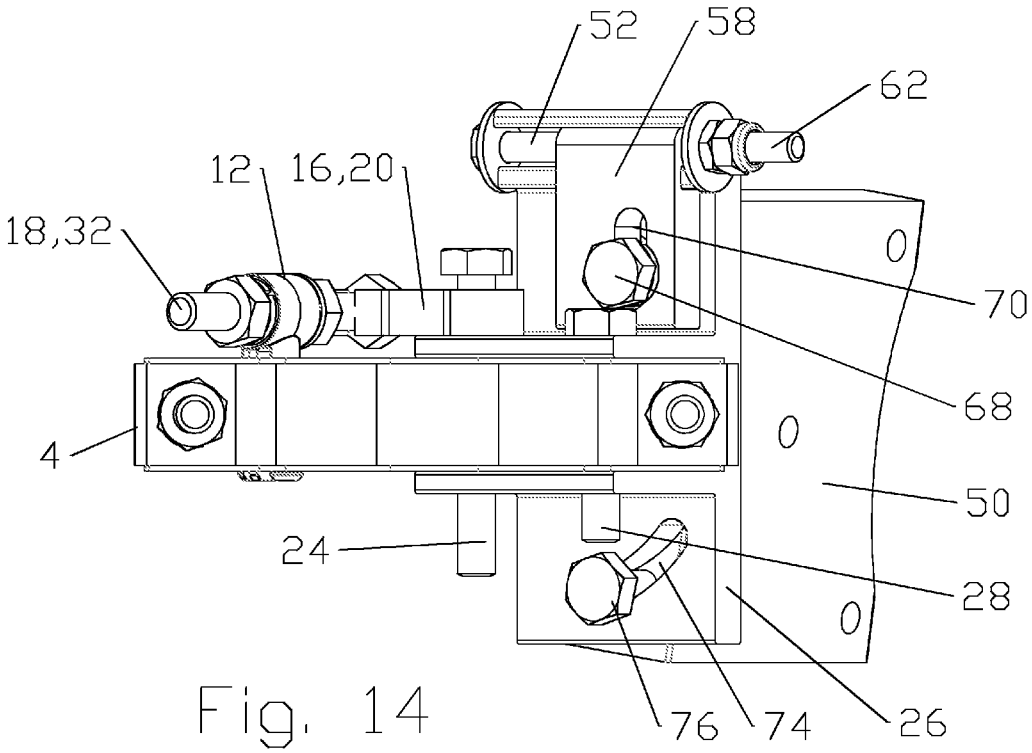
FIG. 14 is a schematic isometric side view of the antenna mount of FIG. 1, with a second elevation pivot slot and fastener.

As best shown in FIG. 14, for further reinforcement of the coupling between the base 26 and the mount 50, a second elevation slot 74 may be provided in the base 26, for example opposite the first elevation slot 64 with respect to the elevation pivot fastener 72. The second elevation slot 74 is similarly provided as an arc segment with a center point at the elevation pivot hole 66. A second elevation alignment fastener 76 passes through the second elevation slot 74 and couples with the mount 50.

Figure 15:
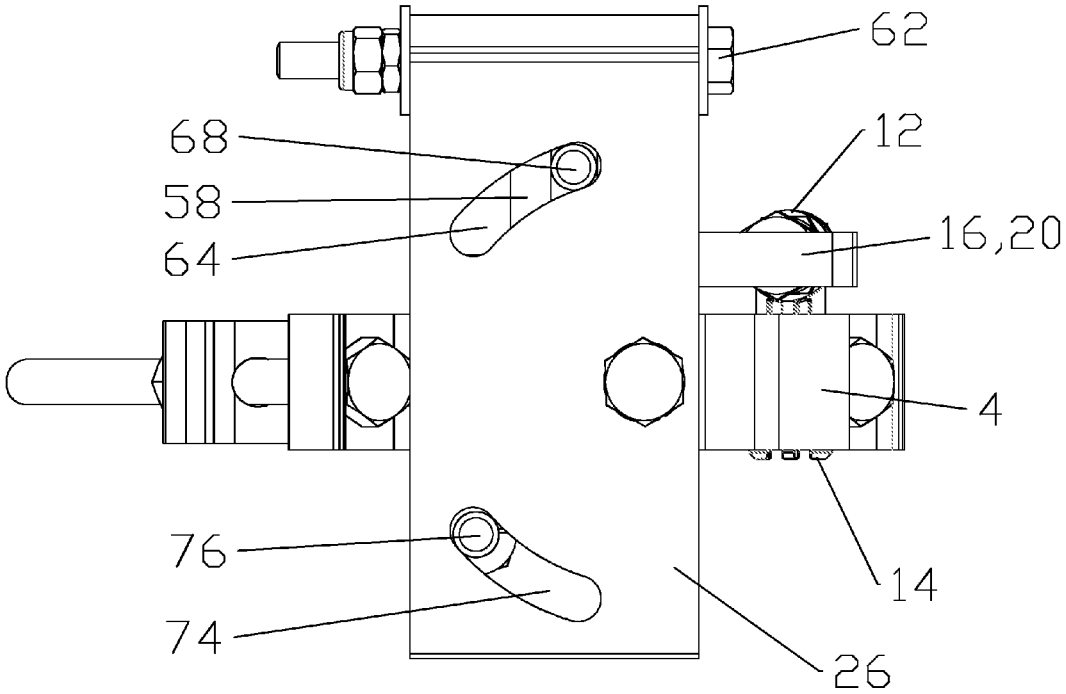
FIG. 15 is a schematic mount side view of the antenna mount of FIG. 14, mount removed for clarity.

The strength of the interconnection between the base 26 and the mount 50 may be further improved by distributing the first elevation alignment fastener 68, the elevation pivot fastener 72 and the second elevation alignment fastener 76 in a triangular rather than linear configuration with respect to one another, as best shown in FIG. 15.

The several fasteners have been demonstrated as standard bolts. Alternatively, one skilled in the art will appreciate that screws, threaded rods, cam closure retainers or the like may be similarly applied as known equivalents.

The antenna mount has been demonstrated in an exemplary embodiment wherein the azimuth arm type pivot is applied to the horizontal or azimuth axis adjustment of the antenna mount and the elevation groove with adjuster applied as the elevation or vertical axis adjustment when mounted upon a vertical pole. One skilled in the art will appreciate that these adjustment axes may be readily exchanged, for example where the bracket 4 is coupled to a horizontal pole or alternatively applied with dual versions of either type of adjustment, instead of one of each.

To adjust the antenna mount, the assembly is coupled to a desired mounting point, such as a pole via the bracket 4. Rough azimuth alignment may be applied by initial adjustment between the pole and the bracket 4, by rotating the antenna mount about the pole and then tightening the bracket 4 to obtain a rigid interconnection with the pole. Fine adjustment of the azimuth orientation may then be applied by loosening the azimuth pivot fastener 28 and the azimuth fastener 24, enabling the azimuth adjuster 16 interconnection position with respect to the boss 12 to pivot the base 26 with respect to the bracket 4 by moving the azimuth fastener 24 along the azimuth slot 6 as the longitudinal position of the extension portion 18 and boss 12 interconnection is adjusted. Once the desired pivot angle has been set, the azimuth pivot fastener 28 and the azimuth fastener 28 are tightened to rigidly interlock the base 26 with the bracket 4.

One skilled in the art will appreciate that, because the azimuth fastener 24 and the azimuth pivot fastener 28 retain the bracket to base interconnection once tightened, the azimuth adjuster 16 and boss 12 need only be provided with sufficient strength to drive the mass of the base 26, mount 50 and attached antenna through the range of available fine pivot adjustment. Thereby, the azimuth adjuster 16 and boss 12 may be provided with reduced strength requirements which may enable materials cost savings.

Fine elevation adjustment of the antenna mount may be performed by loosening the first elevation alignment fastener 68, elevation pivot fastener 72 and second elevation alignment fastener 76, if present. The elevation fastener 62 may then be rotated to drive the adjuster 58 longitudinally within the elevation groove 52, pivoting the mount 50 with respect to the base 26. One skilled in the art will appreciate that, once the desired pivot angle is reached, the first elevation alignment fastener 68, elevation pivot fastener 72 and second elevation alignment fastener 76, if present, may be tightened to rigidly retain the mount 50 at the desired pivot orientation with respect to the base 26. Thereby, the elevation groove 52 and corresponding groove face 60 of the adjuster 58 need only be provided with sufficient strength to drive the mass of the mount 50 and attached antenna through the range of available fine pivot adjustment. Thereby, the elevation groove 52 and groove face 60 may be provided with reduced strength requirements which may enable materials cost savings.

One skilled in the art will appreciate that at least the bracket 4, base 26 and adjuster 58 may be cost effectively formed as an extrusion that is then cut to length and necessary holes bored/threaded.

Further, the antenna mount enables a cost effective compact mount with fine adjustment capability, utilizing a reduced number of separate parts.

| Table of Parts | |
|---|---|
| 4 | bracket |
| 6 | azimuth slot |
| 8 | azimuth pivot hole |
| 10 | boss hole |
| 12 | boss |
| 14 | retention tab |
| 16 | azimuth adjuster |
| 18 | extension portion |
| 20 | offset portion |
| 22 | azimuth fastener aperture |
| 24 | azimuth fastener |
| 26 | base |
| 28 | azimuth pivot fastener |
| 30 | nut |
| 31 | rail |
| 32 | threaded fastener |
| 34 | bolt head slot |
| 36 | bolt head |
| 38 | metal clip |
| 40 | eye bolt |
| 42 | eye portion |
| 44 | threaded portion |
| 46 | bend |
| 48 | reinforcement bracket |
| 50 | mount |
| 52 | elevation groove |
| 54 | groove bottom |
| 56 | bracket side |
| 58 | adjuster |
| 60 | groove face |
| 62 | elevation fastener |
| 64 | first elevation slot |
| 66 | elevation pivot hole |
| 68 | first elevation alignment fastener |
| 70 | adjuster slot |
| 72 | elevation pivot fastener |
| 74 | second elevation slot |
| 76 | second elevation alignment fastener |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An antenna mount, comprising:

a bracket with an azimuth slot, an azimuth pivot hole and a boss hole;

a boss seated in the boss hole;

an azimuth adjuster with an extension portion passing through the boss and an offset portion, the offset portion provided with an azimuth fastener aperture spaced apart from a longitudinal axis of the extension portion;

an azimuth fastener passing through a base, the azimuth slot and the azimuth fastener aperture;

an azimuth pivot fastener passing through the base and the azimuth pivot hole;

the azimuth slot provided as an arc segment with a center point at the azimuth pivot hole;

an elevation groove on the base, the elevation groove provided with a groove bottom open on a bracket side of the base;

an adjuster with a groove face dimensioned to seat within the elevation groove;

an extension fastener co-axial with the elevation groove threadably coupled with the adjuster wherein rotation of the extension fastener drives the adjuster longitudinally along the elevation groove;

the base provided with a first elevation slot and an elevation pivot hole;

the first elevation slot provided as an arc segment with a center point at the elevation pivot hole;

a first elevation alignment fastener passes through an adjuster slot of the adjuster and the first elevation slot and couples with a mount portion;

an elevation pivot fastener passes through the elevation pivot hole and couples with the mount portion;

whereby longitudinal displacement of the adjuster along the elevation groove moves the first elevation alignment fastener along the first elevation slot, rotating the mount portion with respect to the elevation pivot fastener;

whereby adjustment of a longitudinal position along the extension portion of an interconnection between the boss and the extension portion drives the azimuth fastener within the azimuth slot to pivot the base with respect to the bracket.

2. The antenna mount of claim 1, wherein the azimuth slot is proximate a mid-point of the bracket.

3. The antenna mount of claim 1, wherein the extension portion is a threaded fastener coupled to the offset portion via a bolt head slot of the offset portion dimensioned for an interference fit with a bolt head of the threaded fastener.

4. The antenna mount of claim 1, wherein the extension portion is a threaded fastener and the offset portion is a metal clip coupled to a bolt head of the threaded fastener by bending of the metal clip around the bolt head.

5. The antenna mount of claim 1, wherein the azimuth adjuster is an eye bolt with an eye portion and a threaded portion, the threaded portion of the eye bolt provided with a bend; the bend dividing the eyebolt into the extension portion and the offset portion.

6. The antenna mount of claim 1, further including a reinforcing bracket; the reinforcing bracket provided below the bracket, coupled to the bracket by the azimuth fastener and the azimuth pivot fastener.

7. The antenna mount of claim 1, further including a second elevation slot in the base; the second elevation slot provided as an arc segment with a center point at the elevation pivot hole; a second elevation alignment fastener passes through the second elevation slot and couples with the mount portion.

8. The antenna mount of claim 7, wherein the first elevation alignment fastener, the second elevation alignment fastener and the elevation pivot fastener are provided in a triangular configuration with respect to one another.

* * * * *